US008394753B2

(12) United States Patent
Wagner et al.

(10) Patent No.: US 8,394,753 B2
(45) **Date of Patent: *Mar. 12, 2013**

(54) THREE DIMENSIONAL FEEL BENEFITS TO FABRIC

(75) Inventors: Matthew Scott Wagner, Cincinnati, OH (US); Leslie Dawn Waits, Cincinnati, OH (US); Janine A. Flood, Cincinnati, OH (US); Mark Gregory Solinsky, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 197 days.

This patent is subject to a terminal disclaimer.

(21) Appl. No.: 12/905,372

(22) Filed: Oct. 15, 2010

(65) Prior Publication Data

US 2011/0245137 A1 Oct. 6, 2011

Related U.S. Application Data

(60) Provisional application No. 61/320,105, filed on Apr. 1, 2010.

(51) Int. Cl.
*C11D 3/37* (2006.01)

(52) U.S. Cl. ..... 510/466; 510/522; 510/527

(58) Field of Classification Search ..... 510/466, 510/522, 527
See application file for complete search history.

(56) References Cited

U.S. PATENT DOCUMENTS

| | | | | |
|---|---|---|---|---|
| 7,683,119 | B2 | 3/2010 | Creutz et al. | |
| 2003/0126282 | A1 | 7/2003 | Sarkar et al. | |
| 2004/0204337 | A1 | 10/2004 | Corona, II et al. | |
| 2005/0276948 | A1* | 12/2005 | Emery et al. | 428/91 |
| 2007/0199157 | A1* | 8/2007 | Torres et al. | 8/115.51 |
| 2007/0203263 | A1 | 8/2007 | Schroeck et al. | |
| 2009/0311211 | A1 | 12/2009 | Chrobaczek et al. | |
| 2010/0049222 | A1* | 2/2010 | Cherok et al. | 606/151 |
| 2010/0267601 | A1 | 10/2010 | Panandiker et al. | |

FOREIGN PATENT DOCUMENTS

DE 102005017277 A1 4/2006

OTHER PUBLICATIONS

International Search Report for International Appl. No. PCT/US2011/030856, mailed Jul. 5, 2011, 12 pages.

* cited by examiner

*Primary Examiner* — John Hardee
(74) *Attorney, Agent, or Firm* — James F. McBride; Melissa G. Krasovec; Steven W. Miller

(57) ABSTRACT

Methods of assessing three dimensional fabric feel are useful for identifying fabric care actives.

4 Claims, 3 Drawing Sheets

THREE DIMENSIONAL FEEL BENEFITS TO FABRIC

CROSS REFERENCE TO RELATED APPLICATION

This application claims the benefit of U.S. Provisional Application No. 61/320,105, filed Apr. 1, 2010.

FIELD OF INVENTION

The present invention is related to methods of assessing deposition kinetics and three dimensional feel benefits of composition, and compositions exhibiting the same.

BACKGROUND OF THE INVENTION

Fabric actives that impart fabric feel benefits have been described. Quaternary ammonium compounds have been commercially used in fabric softener products. However, many of these actives provide what some consumers describe as a greasy feel on fabric. The use of silicones such as polydimethylsiloxanes have also been commercially used in fabric softener products, but provide what some consumers describe as a too stiff or crisp feel on benefits. There is a need for a method to identify actives that provide unique and desirable feel benefits on fabrics. There is a need to identify these actives objectively (opposed to subjective characteristics). There is need for actives that can provide such unique feel benefits.

Many actives are delivered to fabric through the wash and/or rinse cycle of washing machines. Many actives may impart desirable properties to fabrics but lack the ability to effectively bind to fabric. There is a need to identify actives that will efficiently bind to fabric during wash/rinse cycle.

SUMMARY OF THE INVENTION

The present invent attempts to address one or more of these needs by providing, in a first aspect of the invention, a fabric care composition active comprising: a Friction Test Ratio from about 0.83 to about 0.90, alternatively from about 0.85 to about 0.89; a Compression Test Ratio lower than about 0.86, alternatively from about 0.70 to about 0.86, alternatively from about 0.73 to about 0.86; and a Stiffness Test Ratio lower than about 0.67, alternatively from about 0.35 to about 0.67, alternatively from about 0.39 to about 0.64, alternatively from about 0.44 to about 0.64. In one embodiment, the active comprises a silicone emulsion and has Tau Value that is greater than about 1 and less than about 10, preferably less than about 5.

In another aspect of the invention provides for a method of identifying an active for use as a fabric care active comprising the steps: assessing a Friction Test Ratio of the active; assessing a Compression Test Ratio of the active; and assessing a Stiffness Test Ratio of the active. In one embodiment, the method further comprises the steps of determining whether: the Friction Test Ratio of the active is from about 0.83 to about 0.90, alternatively from about 0.85 to about 0.89; the Compression Test Ratio of the active is lower than about 0.86, alternatively from about 0.70 to about 0.86, alternatively from about 0.73 to about 0.86; and the Stiffness Test Ratio of the active is lower than about 0.67, alternatively from about 0.35 to about 0.67, alternatively from about 0.39 to about 0.64, alternatively from about 0.44 to about 0.64. In another embodiment, wherein the active is a silicone emulsion, the method further comprises the step of assessing a Tau Value of the active.

Yet another aspect of the invention provides for a method of identifying a silicone emulsion for use as a fabric care active comprising the step of identifying the silicone emulsion's Tau Value. In one embodiment, the method further comprises the step of determining whether the Tau Value of the silicone emulsion is between about 1 and about 10, preferably between about 1 and about 5.

DETAILED DESCRIPTION OF THE INVENTION

Figure 1:
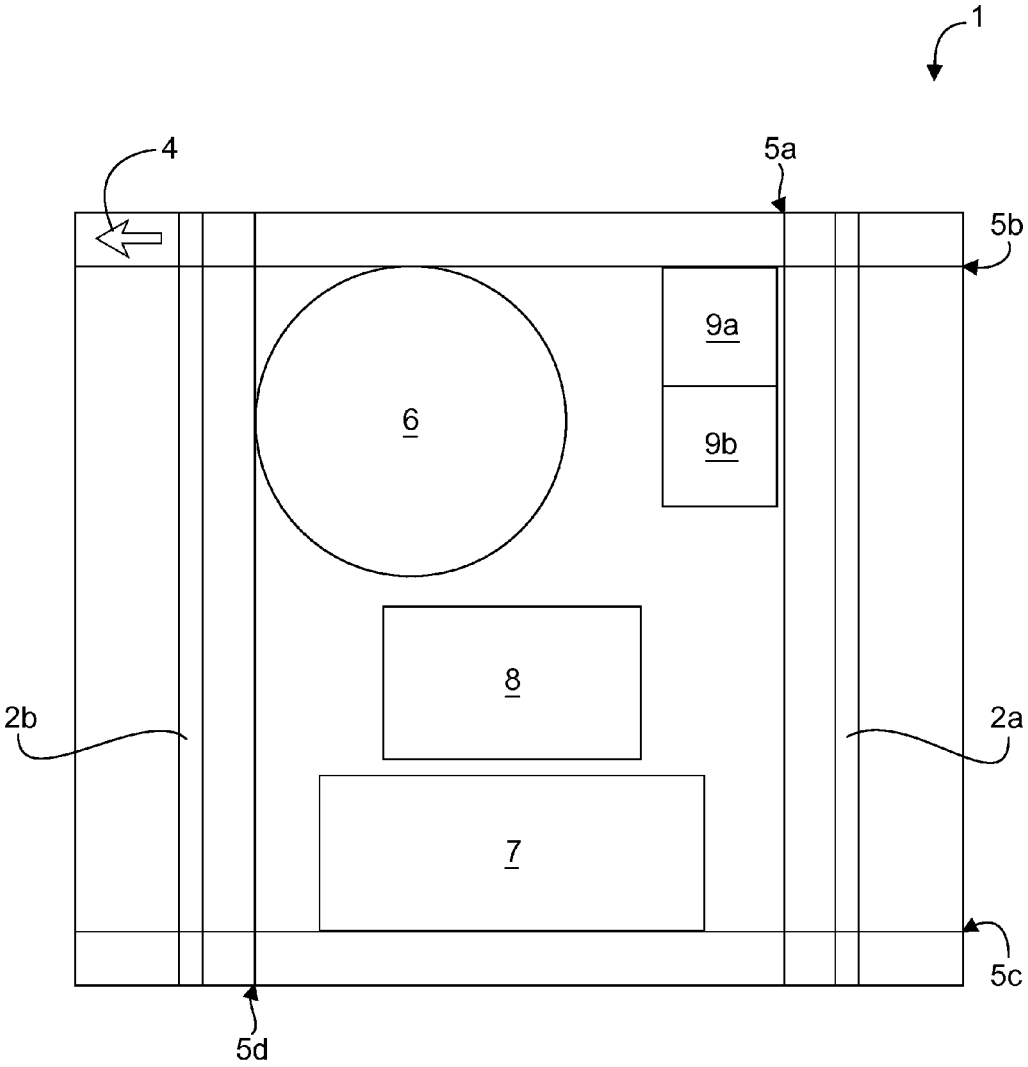
FIG. 1 is a top view of a fabric cloth showing orientation and measurement locations.

These methods describe the objective and quantitative measurement of tactile feel characteristics imparted by chemistries deposited onto fabric surfaces, and the objective and quantitative measurement of deposition kinetics of chemistries used in laundry products. The measurement protocols described measure the effect of deposited chemical treatments on the Friction, Stiffness and Compression of fabric within a three dimensional parameter space which uniquely defines the tactile feel imparted by the chemical treatment. The measurement protocols described also measure the deposition kinetics of deposited chemical treatments, which defines the efficient surface delivery of the chemical treatment.

Fabric Cloths

The fabric to be used is a 100% ring spun cotton, white terry (warp pile weave) towel wash cloth of Eurotouch brand, product number 63491624859, manufactured by Standard Textile (Standard Textile Company, Cincinnati Ohio). Each fabric cloth is approximately 33 cm×33 cm, and weighs approximately 680 g per 12 cloths, and has pile nominal loop sizes of 10-12 mm If this particular fabric is unavailable when requested, then a brand of new terry fabric which meets the same physical specifications listed, and has the warp & weft weave directions clearly identified, may be used as a substitute.

Fabric Cloth Desizing—Preparation Prior to Treatment

The following desizing procedure is used to prepare the fabric cloths prior to their use in deposition testing. Fabrics are desized in a residential top-loading washing, with 35 fabric cloths per load, using reverse osmosis water at 49° C., and 64.35 L of water per fill. Each load is washed for at least 5 complete normal wash-rinse-spin cycles. The desizing step consists of two normal cycles with detergent added at the beginning of each cycle, followed by 3 more cycles with no detergent added. The detergent used is the 2003 AATCC Standard Reference Liquid Detergent (American Association of Textile Chemists and Colorists) at 119 g of per cycle for the 64.35 L. If suds are still present after the third no-detergent-added cycle, as determined by the presence of visible bubbles on the surface of the rinse water prior to the spin step, then continue with additional no-detergent added cycles until no suds are visible. The fabric cloths are then dried in a residential-grade electric-heated tumble dryer on highest heat setting until thoroughly dry, approximately 55 minutes.

After the fabric cloths are removed from the dryer, they are weighed to 0.01 g accuracy, and grouped by weight such that within each grouping there is ≦1 g variation in weight. On each day of measuring, ten or more replicate polydimethylsiloxane (PDMS) control-treatment samples must be run along with the 10 or more replicate test-treatments samples, and all fabric cloths used per day of measuring must be of equal weight to within 1 g (dry weight prior to treatments). For example, fabric cloths within the weight range of 59.00 g and 59.99 g would be grouped together. The treated fabrics are laid flat during storage and are used within a week of coating with treatment.

Preparation of Test Materials

Those test materials which are not miscible in water and the PDMS control-treatment are used as aqueous emulsions. Preparation of silicone emulsions is well known to a person skilled in the art. See for example U.S. Pat. No. 7,683,119 and U.S. Patent Application 2007/0203263A1. Those skilled in the art will also understand that such emulsions can be produced using a variety of different surfactants or emulsifiers, depending upon the characteristics of each specific material. These emulsifiers can be selected from anionic, cationic, nonionic, zwitterionic or amphoteric surfactants. Preferred surfactants are listed in U.S. Pat. No. 7,683,119.

In one embodiment, the emulsifier is a nonionic surfactant selected from polyoxyalkylene alkyl ethers, polyoxyalkylene alkyl phenol ethers, alkyl polyglucosides, polyvinyl alcohol and glucose amide surfactant. Particularly preferred are secondary alkyl polyoxyalkylene alkyl ethers. Examples of such emulsifiers are C11-15 secondary alkyl ethoxylate such as those sold under the trade name Tergitol 15-S-5,
Terigtol 15-S-12 by Dow Chemical Company of Midland Mich. or Lutensol XL-100 and Lutensol XL-50 by BASF, AG of Ludwigschaefen, Germany. Examples of branched polyoxyalkylene alkyl ethers include those with one or more branches on the alkyl chain such as those available from Dow Chemicals of Midland, Mich. under the trade name Tergitol TMN-10 and Tergiotol TMN-3.

In one embodiment cationic surfactants include quaternary ammonium salts such as alkyl trimethyl ammonium salts, and dialkyl dimethyl ammonium salts. In another embodiment, the surfactant is a quaternary ammonium compound. Preferably, the quaternary ammonium compound is a hydrocarbyl quaternary ammonium compound of formula (II):

Formula (II)

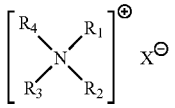

wherein R1 comprises a C12 to C22 hydrocarbyl chain, wherein R2 comprises a C6 to C12 hydrocarbyl chain, wherein R1 has at least two more carbon atoms in the hydrocarbyl chain than R2, wherein R3 and R4 are individually selected from the group consisting of C1-C4 hydrocarbyl, C1-C4 hydroxy hydrocarbyl, benzyl, —(C2H4O)xH where x has a value from about 1 to about 10, and mixtures thereof, and X— is a suitable charge balancing counter ion, in one aspect X— is selected from the group consisting of Cl—, Br—, I—, methyl sulfate, toluene, sulfonate, carboxylate and phosphate or a polyalkoxy quaternary ammonium compound of Formula (III)

Formula (III)

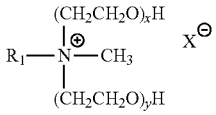

wherein x and y are each independently selected from 1 to 20, and wherein R1 is C6 to C22 alkyl, preferably wherein the aqueous surfactant mixture comprises a surfactant/polyorganosiloxane weight ratio of from about 1:1 to about 1:10 and X— is a suitable charge balancing counter ion, in one aspect X— is selected from the group consisting of Cl—, Br—, I—, methyl sulfate, toluene, sulfonate, carboxylate and phosphate.

Those skilled in the art will understand that such emulsions can be made by mixing the components together using a variety of mixing devices. Examples of suitable overhead mixers include: IKA Labortechnik, and Janke & Kunkel IKA WERK, equipped with impeller blade Divtech Equipment R1342. It is important that each test sample suspension has a volume-weighted, mode particle size of <1,000 nm and preferably >200 nm, as measured >12 hrs after emulsification, and <12 hrs prior to its use in the testing protocol. Particle size distribution is measured using a static laser diffraction instrument, operated in accordance with the manufacturer's instructions. Examples of suitable particle sizing instruments include: Horiba Laser Scattering Particle Size and Distributer Analyzer LA-930 and Malvern Mastersizer.

The PDMS control-treatment used in the testing procedure is a polydimethylsiloxane emulsion made with a polydimethyl siloxane of 350 centistoke viscosity, emulsified with a nonionic surfactant to achieve a target particle size of about 200 nm to about 800 nm. A non-limiting example is that available under the trade name DC 349 from Dow Corning Corporation, Midland, Mich. The PDMS control-treatment and test materials which are non-miscible in water are to be prepared for testing by being made into a simple emulsion of at least 0.1% active test material concentration (wt/wt), in deionised water, with a particle size distribution which is stable for at least 48 hrs at room temperature.

Treatment—Coating Fabrics with Emulsion Test Sample or Control-Treatment:

Forced-deposition is used to treat the desized fabric cloths with a coating of the treatment material, at a dose of 1 mg of treatment material/g fabric (active wt/dry wt.). At least ten desized fabric cloth replicates are to be treated and measured for each different treatment chemistry being tested on each day of measurements, and for the PDMS control-treatment which is also included on each day of measurements.

Attain a 0.1% concentration (wt/wt) of the test material in the treatment sample, using deionized water to dilute if necessary. Weigh out an amount of this 0.1% treatment sample such that it has the same weight as the dry weight of the fabric cloth being treated (within 1 g), and pour that treatment sample into a glass cake pan large approximately 33 cm×38 cm in size. Rinse the container used to measure out the treatment sample with an equal amount of deionized water and add this rinse water to the same pan. Agitate the pan until the solution appears to be homogenously mixed. Lay a single fabric cloth flat into the pan and treatment fluid, with the label/tag side facing downward. Fabric edges which do not fit into the pan should be folded inwards toward the center of the fabric cloth. Distribute the fluid evenly onto the fabric cloth by bunching up the fabric up with two hands and squeezing.

Use the fabric to soak up all excess fluid in the pan. The pans used for coating fabric should be cleaned thoroughly with alcohol wipes and allowed to dry between uses with different treatment chemistries. Treated fabrics are laid flat onto a new sheet of aluminum foil until all replicates for that treatment are completed. These replicate fabrics are then tumble dried together, and may require the addition of clean, untreated, desized fabric to act as a ballast to ensure proper tumbling. Tumble dry treated fabrics in a residential-grade electric-heated tumble dryer on highest heat setting for approximately 55 minutes. Replicate fabrics of each test treatment chemistry and in the PDMS control-treatment should be dried in separate dryer loads, to prevent cross-contamination between different treatment chemistries.

Conditioning/Equilibration:

When drying is completed, the treated fabric cloths are equilibrated for a minimum of 8 hours at 23° C. and 50% Relative Humidity. Treated and equilibrated fabrics are measured within 2 days of treatment. Treated fabrics are laid flat and stacked no more than 10 cloths high while equilibrating. Compression, Friction and Stiffness measurements are all conducted under the same environmental conditions use during the conditioning/equilibration step.

Preparation of Coated Fabric Cloths for 3D Feel Measurements:

Three types of measurements are made on the same day on each treated fabric cloth—1 Compression, 1 Friction, and 2 Stiffness measures, using at least 10 replicate fabric cloths for each test treatment and for the PDMS control-treatment. Compression, Friction, and Stiffness measurements are all conducted under the same environmental conditions use during the conditioning/equilibration step, namely; 23° C. and 50% Relative Humidity. A desized and equilibrated fabric cloth is obtained (1). The fabric's tag/label side is placed down and the face of the fabric, (3), is then defined as the side that is upwards. If there is no tag and the fabric is different on the front and back, it is important to establish one side of the terry fabric as being designated "face" and be consistent with that designation across all fabric cloths. The fabric (1) is then oriented so that the bands (2*a*, 2*b*) (which are parallel to the weft of the weave) are on the right and left and the top of the pile loops are pointing towards the left as indicated by the arrow (4)—see FIG. 1. The fabrics are marked with a permanent ink marker pen to create straight lines (5*a*, 5*b*, 5*c*, 5*d*), parallel to and 2.54 cm in from the top and bottom sides and the bands. All measurements are made within the area defined by the marker pen lines (5*a*)—see FIG. 1 for details.

Table 1 lists the fabric sample size for each of the measurements. The fabrics are marked accordingly with a permanent ink marker pen while carefully aligning the straight lines with the warp and weft directions of the fabrics. Compression is measured before cutting the samples for stiffness and friction measurements. Cutting is done with fabric shears, along the marked line—see FIG. 1.

TABLE 1

| | Sample Size | Additional Information |
|---|---|---|
| Compression | Compression Area (6): 10.2 cm diameter | Mark diameter on fabric only; they are not cut out |
| Friction | Sled Area (7): 11.4 cm × 6.4 cm | Drag Area (8) (not marked nor cut out): ~11.4 cm × 6.4 cm |
| Stiffness | Taber Specimen Cut 7.6 cm × 3.8 cm | Cut in half for two samples (9a, 9b) 3.8 cm × 3.8 cm each |

Compression Measure:

Compression of the fabric is measured by a tensile tester. Suitable tensile testers for this measurement are single or dual column tabletop systems for low-force applications of 1 to 10 kN, or systems for higher force tensile testers. Suitable testers are the MTS Insight Series (MTS Systems Corporation, Pittsburgh, Pa.) and the Instron's 5000 series for Low-Force Testing. A 100 Newton load cell is used to make the measures. A sample stage is a flat circular plate, machined of metal harder than 100 HRB (Rockwell Hardness Scale) and has a diameter of 15 cm. This is used for the bottom platen. A suitable stage is Model 2501-163 (Instron, Norwood, Mass.). The compression head is made of a hard plastic such as polycarbonate or Lexan. It is 10.2 cm in diameter and 2.54 cm thick with a smooth surface. The following settings are used to make the measure:

| | |
|---|---|
| Data Acquisition Rate: | 10 Hz |
| Platen Separation: | 10.00 mm |
| Compression Head Rate: | 1 mm/min |
| Compression Stop 1: | 2.80 mm |
| Compression Stop 2: | 85% of load cell |
| Load Units: | Kgf |

The gap between platens is set at 10.00 mm

The fabric is placed on the bottom platen and aligned with the compression area mark (FIG. 1) under the compression head, without billows or folds in the fabric due to placement on the sample plate. After the measurement is taken, the load and extension values for each sample are saved. The bottom platen and compression head are cleaned with an alcohol wipe and allowed to dry completely between sample treatments. For each treatment, ten replicate fabrics are measured.

Calculating the Compression Parameter:

The slope of the compression curve is derived in the following manner. The Y variable denotes the natural log of the measured load and the X variable denotes the extension. The slope is calculated using a simple linear regression of Y on X over the load range of 0.005 and 3.5 kgf. This is calculated for each fabric cloth measured and the value is reported as kgf/mm Friction Measures:

For the examples cited a Thwing-Albert FP2250 Friction/Peel Tester with a 2 kilogram force load cell is used to measure fabric to fabric friction. (Thwing Albert Instrument Company, West Berlin, N.J.), The sled is a clamping style sled with a 6.4 by 6.4 cm footprint and weighs 200 g (Thwing Albert Model Number 00225-218). A comparable instrument to measure fabric to fabric friction would be an instrument capable of measuring frictional properties of a horizontal surface. A 200 gram sled that has footprint of 6.4 cm by 6.4 cm and has a way to securely clamp the fabric without stretching it would be comparable. It is important, though, that the sled remains parallel to and in contact with the fabric during the measurement. The distance between the load cell to the sled is set at 10.2 cm. The crosshead arm height to the sample stage is adjusted to 25 mm (measured from the bottom of the cross arm to the top of the stage) to ensure that the sled remains parallel to and in contact with the fabric during the measurement. The following settings are used to make the measure:

| | |
|---|---|
| T2 (Kinetic Measure): | 10.0 sec |
| Total Time: | 20.0 sec |
| Test Rate: | 20.0 cm/min |

Figure 2:
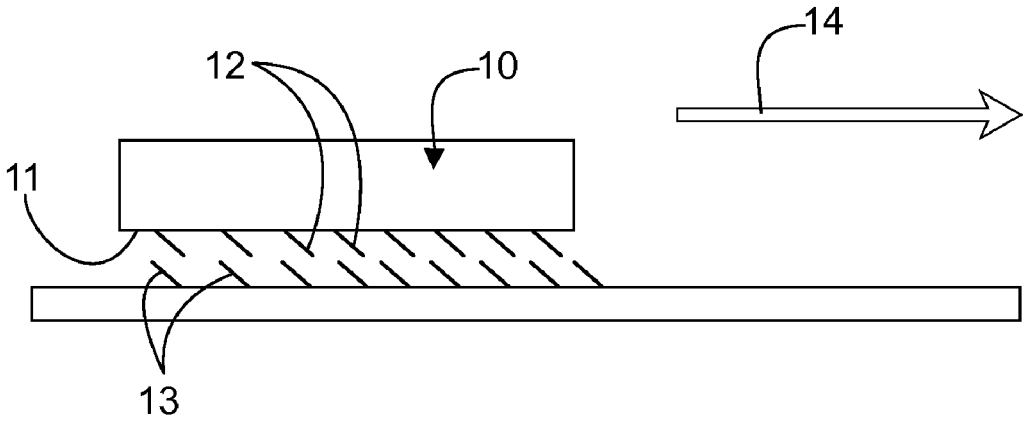
FIG. 2 is an elevation view of fabric cloth during taber friction testing

The 11.4 cm×6.4 cm cut fabric piece is attached, per FIG. 2, to the clamping sled (10) with the face down (11) (so that the face of the fabric on the sled is pulled across the face of the fabric on the sample plate) which corresponds to friction sled cut (7) of FIG. 1. Referring to FIG. 2, the loops of the fabric on the sled (12) are oriented such that when the sled (10) is pulled, the fabric (11) is pulled against the nap of the loops (12) of the test fabric cloth (see FIG. 2). The fabric from which the sled sample is cut is attached to the sample table such that the sled drags over the area labeled "Friction Drag Area" (8) as seen in FIG. 1. The loop orientation (13) is such that when the sled is pulled over the fabric it is pulled against the loops (13) (see FIG. 2). Direction arrow (14) indicates direction of sled (10) movement.

The sled is placed on the fabric and attached to the load cell. The crosshead is moved until the load cell registers between ~1.0-2.0 gf, and is then moved back until the load reads 0.0 gf. At this point the sled drag is commenced and the Kinetic Coefficient of Friction (kCOF) recorded at least every second during the sled drag. The kinetic coefficient of friction is averaged over the time frame starting at 10 seconds and ending at 20 seconds for the sled speed set at 20.0 cm/min For each treatment, at least ten replicate fabrics are measured.

Stiffness Measures (Sometimes Also Known as Bend):

Assessment of fabric stiffness is measured by a Taber Stiffness Tester (Model 150-E, Taber Industries, North Tonawanda, N.Y.). The following settings are used for the Taber:

| | |
|---|---|
| Range | 2 |
| Rollers | Up |
| Weight | Compensator 10 g |
| Cycles | 5 |
| Direction | Left & Right |
| Deflection | 15 Degrees |

The sample for the Taber measure is placed into the clamps such that the face of the fabric is to the right and rows of loops are vertical and the loops of the fabric pointing outward, not towards the instruments. The Taber clamps are tightened just enough to secure the fabrics and not cause deformation at the pivotal point. The measurement is made and the average stiffness units (SU) for each fabric is recorded. Taber Stiffness Units are defined as the bending moment of ⅕ of a gram applied to a 3.81 cm wide specimen at a 5 cm test length, flexing it to an angle of 15°. A Stiffness Unit is the equivalent of one gram force centimeter. For each treatment, two measurements are made on each of at least ten replicate fabrics. The average value for each fabric is calculated from the two measures performed on that fabric. The clamps and rollers are cleaned with an alcohol wipe and allowed to dry completely between sample treatments.

A comparable instrument to measure stiffness would be a Kawabata KES-FB2, Kato-Tech Corporation LTD. Japan. If a Kawabata stiffness tester is used, then an additional 10 fabrics should be prepared, since for each test 20 by 20 cm samples are used. They are bent in the weft orientation. The following settings are used: Sensitivity=20 and Curvature=2.5 $cm^{-1}$. The stiffness (bending rigidity) is recorded for each measure.

Data Analysis & Statistical Methods:

For the PDMS control-treatment and for each test-treatment material, the mean for each of the three methods (stiffness, friction and compression) is calculated from the ten or more replicate measurements conducted. The mean for each test treatment material is divided by the PDMS control-treatment mean for each respective test method, using only data measured on the same day. This results in a ratio value for each test-treatment, for each of the three Feel Methods.

Friction Ratio Value for Treatment *X*=Friction Mean of Test Treatment *X*/Friction Mean of PDMS Control Treatment;

Compression Ratio Value for Treatment *X*=Compression Mean of Test Treatment *X*/Compression Mean of PDMS Control Treatment;

Stiffness Ratio Value for Treatment *X*=Stiffness Mean of Test Treatment *X*/Stiffness Mean of PDMS Control Treatment;

wherein "X" is the test material.

To compute the 95% confidence interval for ratios the Generalized Estimation Equation based approach is used, as described in the following publication: Ratio Estimation via Poisson Regression and Generalized Estimating Equations (2008), Jorge G. Morel and Nagaraj K. Neerchal, Statistics and Probability Letters, Volume 78, Issue 14, 2188-2193.

Data of various test materials and PDMS are evaluated for Friction, Compression, and Stiffness per the method described herein. The structures and methods of making these materials are detailed in the Examples section.

| Material | Friction[A] | Compression[B] | Stiffness[C] |
|---|---|---|---|
| Quaternary Ammonium[1] | 0.806-0.826 | 0.798-0.904 | 0.391-0.484 |
| *SLM 21230 - mod B[2] | 0.809-0.866 | 0.765-0.863 | 0.476-0.585 |
| *SLM 2121-4[3] | 0.573-0.716 | 0.739-0.801 | 0.449-0.604 |
| *X-22-8699-3S[4] | 0.848-0.882 | 0.733-0.808 | 0.573-0.716 |
| *SLM 21230[5] | 0.860-0.890 | 0.731-0.794 | 0.489-0.637 |
| SLM 466-01-05[6] | 0.898-0.921 | 0.772-0.854 | 0.755-0.898 |
| PDMS | 1 | 1 | 1 |

[1]Bis-(2-hydroxyethyl)-dimethylammonium chloride fatty acid ester available from Evonik.
[2]SLM 21230 - mod B is described in Example 2 below.
[3]SLM 2121-4 is described in Example 3 below.
[4]X22-8699-3S is described in Example 4 below.
[5]SLM 21230 is described in Example 5 below.
[6]SLM 466-01-05 is described in Example 6 below.
[A]A number lower than 1 is lower friction relative to PDMS.
[B]A number lower than 1 is lower compression relative to PDMS.
[C]A number lower than 1 is lower stiffness relative to PDMS.
*Compounds within the scope of the present invention as providing unique three dimensional fabric feel benefits.

SLM 2121-4, X-22-8699-35, SLM 21230, are compounds that are within the scope of the present invention that provide unique three dimension fabric feel benefits. Without wishing to be bound by theory, amine content, specifically that of the "capping group" of the silicone fluid, molecular weight and amine/dicarbonal ratio greatly influence the unique fabric feel benefit in which the silicone imparts when delivered to a consumer fabric via the laundering cycle. Given the silicones of interest, it is determined that by adjusting each these aspects of the silicone, one can modify the silicone to optimize the fabric feel benefits with which it provides. Base on the performance vectors listed below, it was determined that as you increase the nitrogen content, decrease the Amine/

Dicarbonal ratio and increase the molecular weight, you can optimize three dimensional fabric feel performance.

| | Nitrogen content of capping group | Amine/Dicarbonal ratio | Structural Information Molecular Weight |
|---|---|---|---|
| SLM 4660105 | ↓ Nitrogen | ↓ Amine/Dicarb | ↑ MW |
| SLM 21230 | ↓ Nitrogen | ↑ Amine/Dicarb | ↓ MW |
| SLM21230 mod B | ↓ Nitrogen | ↓ Amine/Dicarb | ↑ MW |
| SLM 2121419 | ↑ Nitrogen | ↓ Amine/Dicarb | ↑ MW |

Ratio Values

One aspect of the invention provides a Friction Test Ratio from about 0.83 to about 0.90, alternatively from about 0.85 to about 0.89.

Another aspect of the invention provides a Compression Test Ratio lower than about 0.86, alternatively from about 0.70 to about 0.86, alternatively from about 0.73 to about 0.86.

Another aspect of the invention provides a Stiffness Test Ratio lower than about 0.67, alternatively from about 0.35 to about 0.67, alternatively from about 0.39 to about 0.64, alternatively from about 0.44 to about 0.64.

QCM-D Method for Measuring Fabric Deposition Kinetics of a Silicone Emulsion

Another aspect of the invention provides for methods of assessing the Tau Value of a silicone emulsion. Preferably the Tau Value is below 10, more preferably below 5.

This method describes the derivation of a deposition kinetics parameter (Tau) from deposition measurements made using a quartz crystal microbalance with dissipation measurements (QCM-D) with fluid handling provided by a high performance liquid chromatography (HPLC) pumping system. The mean Tau value is derived from triplicate runs, with each run consisting of measurements made using two flow cells in series.

QCM-D Instrument Configuration

Figure 3:
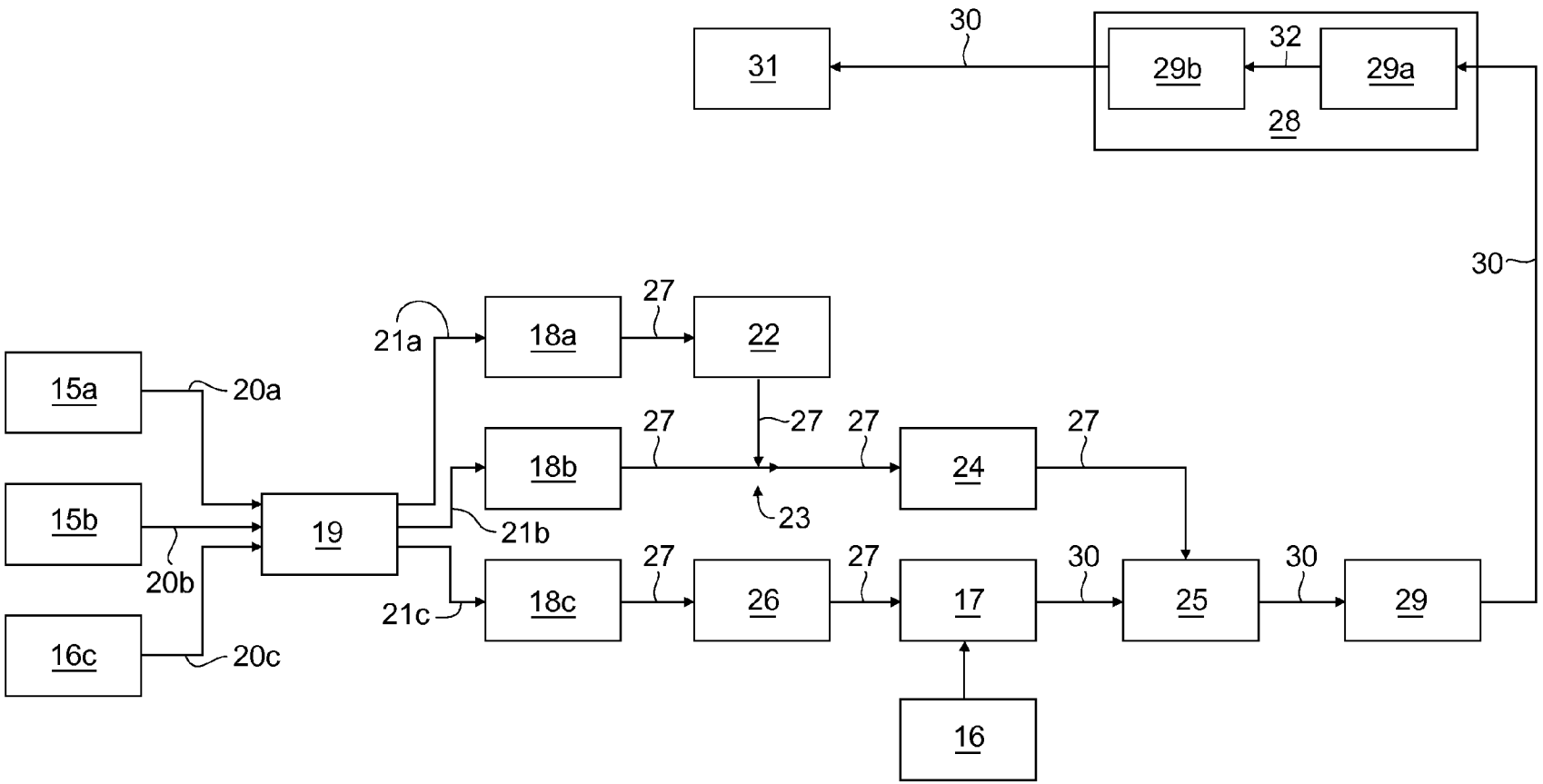
FIG. 3 is a schematic of a combined QCM-D and HPLC Pump set-up.

A schematic of the combined QCM-D and pumping system is shown in FIG. 3.

Carrier Fluid Reservoirs:

Three one liter or greater carrier fluid reservoirs are utilized (15*a*, 15*b*, 15*c*) as follows: Reservoir A: Deionized water (18.2MΩ); Reservoir B: Hard water (15 mM $CaCl_2.2H_2O$ and 5 mM $MgCl_2.6H_2O$ in 18.2 MΩ water); and Reservoir C: Deionized water (18.2 MΩ). All reservoirs are maintained at ambient temperature (approximately 20° C. to 25° C.).

Fluids from these three reservoirs can be mixed in various concentrations under the control of a programmable HPLC pump controller to obtain desired water hardness, pH, ionic strength, or other characteristics of the sample. Reservoirs A and B are used to adjust the water hardness of the sample, and reservoir C is used to add the sample (16) to the fluid stream via the autosampler (17).

Carrier Fluid Degasser:

Prior to entering the pumps (18*a*, 18*b*, 18*c*), the carrier fluids must be degassed. This can be achieved using a 4-channel vacuum degasser (19) (a suitable unit is the Rheodyne/Systec #0001-6501, Upchurch Scientific, a unit of IDEX Corporation, 619 Oak Street, P.O. Box 1529 Oak Harbor, Wash. 98277). Alternatively, the carrier fluids can be degassed using alternative means such as degassing by vacuum filtration. The tubing used to connect the reservoirs to the vacuum degasser (20*a*, 20*b*, 20*c*) is approximately 1.60 mm nominal inside diameter (ID) PTFE tubing (for example, Kimble Chase Life Science and Research Products LLC 1022 Spruce Street PO Box 1502 Vineland N.J. 08362-1502, part number 420823-0018).

Pumping System:

Carrier fluid is pumped from the reservoirs using three single-piston pumps (18*a*, 18*b*, 18*c*), as typically used for HPLC (a suitable pump is the Varian ProStar 210 HPLC Solvent Delivery Modules with 5 ml pump heads, Varian Inc., 2700 Mitchell Drive, Walnut Creek Calif. 94598-1675 USA). It should be noted that peristaltic pumps or pumps equipped with a proportioning valve are not suitable for this method. The tubing (21*a*, 21*b*, 21*c*) used to connect the vacuum degasser to the pumps is the same dimensions and type as those connecting the reservoirs to the degassers.

Pump A is used to pump fluid from Reservoir A (deionized water). Additionally, Pump A is equipped with a pulse dampener (22) (a suitable unit is the 10 ml volume 60 MPa Varian part #0393552501, Varian Inc., 2700 Mitchell Drive, Walnut Creek Calif. 94598-1675 USA) through which the output of Pump A is fed.

Pump B is used to pump fluid from Reservoir B (hard water). The fluid outflow from Pump B is joined to the fluid outflow of Pump A using a T-connector (23). This fluid then passes through a backpressure device (24) that maintains at least approximately 6.89 MPa (a suitable unit is the Upchurch Scientific part number P-455, a unit of IDEX Corporation, 619 Oak Street, P.O. Box 1529 Oak Harbor, Wash. 98277) and is subsequently delivered to a dynamic mixer (25).

Pump C is used to pump fluid from Reservoir C (deionized water). This fluid then passes through a backpressure device (26) that maintains at least approximately 6.89 MPa (a suitable unit is the Upchurch Scientific part number P-455, a unit of IDEX Corporation, 619 Oak Street, P.O. Box 1529 Oak Harbor, Wash. 98277) prior to delivering fluid into the autosampler (17).

Autosampler:

Automated loading and injection of the test sample into the flow stream is accomplished by means of an autosampler device (17) equipped with a 10 ml, approximately 0.762 mm nominal ID sample loop (a suitable unit is the Varian ProStar 420 HPLC Autosampler using a 10 ml, approximately 0.762 mm nominal ID sample loop, Varian Inc., 2700 Mitchell Drive, Walnut Creek Calif. 94598-1675 USA). The tubing (27) used from the pump C outlet to the backpressure device (26), and from the backpressure device (26) to the autosampler (17) is approximately 0.254 mm nominal ID polyetheretherketone (PEEK) tubing (suitable tubing can be obtained from Upchurch Scientific, a unit of IDEX Corporation, 619 Oak Street, P.O. Box 1529 Oak Harbor, Wash. 98277). Fluid exiting the autosampler is delivered to a dynamic mixer (25).

Dynamic Mixer:

All of the flow streams are combined in a 1.2 ml dynamic mixer (25) (a suitable unit is the Varian part #0393555001 (PEEK), Varian Inc., 2700 Mitchell Drive, Walnut Creek Calif. 94598-1675 USA) prior to entering into the QCM-D instrument (28). The tubing used to connect pumps A & B (18*a*, 18*b*) to the dynamic mixer via the pulse dampener (22) and backpressure device (24) is the same dimensions and type as that connecting the pump C (18*c*) to the autosampler via the backpressure device (26). The fluid exiting the dynamic mixer passes through an approximately 0.138 MPa backpressure device (29) (a suitable unit is the Upchurch Scientific part number P-791, a unit of IDEX Corporation, 619 Oak Street, P.O. Box 1529 Oak Harbor, Wash. 98277) before entering the QCM-D instrument.

QCM-D:

The QCM-D instrument should be capable of collecting frequency shift (Δf) and dissipation shift (ΔD) measurements relative to bulk fluid over time using at least two flow cells (29*a*, 29*b*) whose temperature is held constant at 25 C.±0.3 C. The QCM-D instrument is equipped with two flow cells, each having approximately 140 μl in total internal fluid volume, arranged in series to enable two measurements (a suitable instrument is the Q-Sense E4 equipped with QFM 401 flow cells, Biolin Scientific Inc. 808 Landmark Drive, Suite 124 Glen Burnie, Md. 21061 USA). The theory and principles of the QCM-D instrument are described in U.S. Pat. No. 6,006,589.

The tubing (30) used from the autosampler to the dynamic mixer and all device connections downstream thereafter is approximately 0.762 mm nominal ID PEEK tubing (Upchurch Scientific, a unit of IDEX Corporation, 619 Oak Street, P.O. Box 1529 Oak Harbor, Wash. 98277). Total fluid volume between the autosampler (17) and the inlet to the first QCM-D flow cell (29*a*) is 3.4 ml±0.2 ml.

The tubing (32) between the first and second QCM-D flow cell in the QCM-D instrument should be approximately 0.762 mm nominal ID PEEK tubing (Upchurch Scientific, a unit of IDEX Corporation, 619 Oak Street, P.O. Box 1529 Oak Harbor, Wash. 98277) and between 8 and 15 cm in length. The outlet of the second flow cell flows via PEEK tubing (30) 0.762 mm ID, into a waste container (31), which must reside between 45 cm and 60 cm above the QCM-D flow cell #2 (29*b*) surface. This provides a slight amount of backpressure, which is necessary for the QCM-D to maintain a stable baseline and prevent siphoning of fluid out of the QCM-D.

Test Sample Preparation

Silicone test materials are to be prepared for testing by being made into a simple emulsion of at least 0.1% test material concentration (wt/wt), in deionised water (i.e., not a complex formulation), with a particle size distribution which is stable for at least 48 hrs at room temperature. Those skilled in the art will understand that such suspensions can be produced using a variety of different surfactants or solvents, depending upon the characteristics of each specific material. Examples of surfactants & solvents which may be successfully used to create such suspensions include: ethanol, Isofol 12, Arquad HTL8-MS, Tergitol 15-S-5, Terigtol 15-S-12, TMN-10 and TMN-3. Salts or other chemical(s) that would affect the deposition of the active should not to be added to the test sample. Those skilled in the art will understand that such suspensions can be made by mixing the components together using a variety of mixing devices. Examples of suitable overhead mixers include: IKA Labortechnik, and Janke & Kunkel IKA WERK, equipped with impeller blade Divtech Equipment R1342. It is important that each test sample suspension has a volume-weighted, mode particle size of <1,000 nm and preferably >200 nm, as measured >12 hrs after emulsification, and <12 hrs prior to its use in the testing protocol. Particle size distribution is measured using a static laser diffraction instrument, operated in accordance with the manufactures instructions. Examples of suitable particle sizing instruments include: Horiba Laser Scattering Particle Size and Distributer Analyzer LA-930 and Malvern Mastersizer.

The silicone emulsion samples, prepared as described above, are initially diluted to 2000 ppm (vol/vol) using degassed 18.2 MΩ water and placed into a 10 ml autosampler vial (Varian part RK60827510). The sample is subsequently diluted to 800 ppm with degassed, deionized water (18.2 MΩ) and then capped, crimped and thoroughly mixed on a Vortex mixer for 30 seconds.

QCM-D Data Acquisition

Microbalance sensors fabricated from AT-cut quartz and being approximately 14 mm in diameter with a fundamental resonant frequency of 4.95 MHz±50 KHz are used in this method. These microbalance sensors are coated with approximately 100 nm of gold followed by nominally 50 nm of silicon dioxide (a suitable sensor is available from Q-Sense, Biolin Scientific Inc. 808 Landmark Drive, Suite 124 Glen Burnie, Md. 21061 USA). The microbalance sensors are loaded into the QCM-D flow cells, which are then placed into the QCM-D instrument. Using the programmable HPLC pump controller, the following three stage pumping protocol is programmed and implemented.

Fluid Flow Rates for Pumping Protocol:

Fluid flow rates for pumps are: Pump A: Deionized water (18.2 MΩ) at 0.6 ml/min; Pump B: Hard water (15 mM CaCl2.2H2O and 5 mM MgCl2.6H2O in 18.2 MΩ water) at 0.3 ml/min; and Pump C: Deionized water (18.2 MΩ) at 0.1 ml/min.

These flow rates are used throughout the three stages delineated below. The three stages described below are collectively referred to as the "pumping protocol". The test sample only passes over the microbalance sensor during Stage 2.

Pumping Protocol Stage 1: System Equilibration

Fluid flow using pumps A, B, and C is started and the system is allowed to equilibrate for at least 60 minutes at 25 C. Data collection using the QCM-D instrument should begin once fluid flow has begun. The QCM-D instrument is used to collect the frequency shift (Δf) and dissipation shift (ΔD) at the third, fifth, seventh, and ninth harmonics (i.e. f3, f5, f7, and f9 and d3, d5, d7, and d9 for the frequency and dissipation shifts, respectively) by collecting these measurements at each of these harmonics at least once every four seconds.

Stage 1 should be continued until stability is established. Stability is defined as obtaining an absolute value of less than 0.75 Hz/hour for the slope of the $1^{st}$ order linear best fit across 60 contiguous minutes of frequency shift and also an absolute value of less than 0.2 Hz/hour for the slope of the $1^{st}$ order linear best fit across 60 contiguous minutes of dissipation shift, from each of the third, fifth, seventh, and ninth harmonics. Meeting this requirement may require restarting this stage and/or replacement of the microbalance sensor.

Once stability has been established, the sample to be tested is placed into the appropriate position in the autosampler device for uptake into the sample loop. Six milliliters of the test sample is then loaded into the sample loop using the autosampler device without placing the sample loop in the path of the flow stream. The flow rate used to load the sample into the sample loop should be less than 0.5 ml/min to avoid cavitation.

Pumping Protocol Stage 2: Test Sample Analysis

At the beginning of this stage, the sample loop loaded with the sample is now placed into the flow stream of fluid flowing into the QCM-D instrument using the autosampler switching valve. This results in the dilution and flow of the test sample across the QCM-D sensor surfaces. Data collection using the QCM-D instrument should continue throughout this stage. The QCM-D instrument is used to collect the frequency shift (Δf) and dissipation shift (ΔD) at the third, fifth, seventh, and ninth harmonics (i.e. f3, f5, f7, and f9 and d3, d5, d7, and d9 for the frequency and dissipation shifts, respectively) by collecting these measurements at each of these harmonics at least once every four seconds. Flow of the test sample across the QCM-D sensor surfaces should proceed for 30 minutes before proceeding to Stage 3.

Pumping Protocol Stage 3: Rinsing

In Stage 3, the sample loop in the autosampler device is removed from the flow stream using the switching valve present in the autosampler device. Fluid flow is continued as described in Stage 1 without the presence of the test sample. This fluid flow will rinse out residual test sample from the tubing, dynamic mixer, and QCM-D flow cells. Data collection using the QCM-D instrument should continue throughout this stage. The QCM-D instrument is used to collect the frequency shift (Δf) and dissipation shift (ΔD) at the third, fifth, seventh, and ninth harmonics (i.e. f3, f5, f7, and f9 and d3, d5, d7, and d9 for the frequency and dissipation shifts, respectively) by collecting these measurements at each of these harmonics at least once every four seconds. Flow of the sample solution across the QCM-D sensor surfaces should proceed for 30 minutes of rinsing before stopping the flow and QCM-D data collection. The residual sample is removed from the sample loop in the autosampler through the use of nine 10 ml rinse cycles of deionized (18 MΩ) water, each drained to waste.

Upon completion of the pumping protocol, the QCM-D flow cells should be removed from the QCM-D instrument, disassembled, and the microbalance sensors discarded. The metal components of the flow cell should be cleaned by soaking in HPLC grade methanol for one hour followed by subsequent rinses with methanol and HPLC grade acetone. The non-metal components should be rinsed with deionized water (18 MΩ). After rinsing, the flow cell components should be blown dry with compressed nitrogen gas.

Data Analysis

Voigt Viscoelastic Fitting of the QCM-D Frequency Shift and Dissipation Shift Data Analysis of the frequency shift (Δf) and dissipation shift (ΔD) data is performed using the Voigt viscoelastic model as described in M. V. Voinova, M. Rodahl, M. Jonson and B. Kasemo "Viscoelastic Acoustic Response of Layered Polymer Films at Fluid-Solid Interfaces: Continuum Mechanics Approach" Physica Scripta 59: 391-396 (1999). The Voigt viscoelastic model is included in the Q-Tools software (Q-Sense, version 3.0.7.230 and earlier versions), but could be implemented in other software programs. The frequency shift (Δf) and dissipation shift (ΔD) for each monitored harmonic should be zeroed approximately 5 minutes prior to injection of the test sample (i.e. five minutes prior to the beginning of Stage 2 described above).

Fitting of the Δf and ΔD data using the Voigt viscoelastic model is performed using the third, fifth, seventh, and ninth harmonics (i.e. f3, f5, f7, and f9, and d3, d5, d7, and d9, for the frequency and dissipation shifts, respectively) collected during Stages 2 and 3 of the pumping protocol described above. Voigt model fitting is performed using descending incremental fitting, i.e. beginning from the end of Stage 3 and working backwards in time.

In the fitting of Δf and ΔD data obtained from QCM-D measurements, a number of parameters must be determined or assigned. The values used for these parameters may alter the output of the Voigt viscoelastic model, so these parameters are specified here to remove ambiguity. These parameters are classified into three groups: fixed parameters, statically fit parameters, and dynamically fit parameters. The fixed parameters are selected prior to the fitting of the data and do not change during the course of the data fitting. The fixed parameters used in this method are: the density of the carrier fluid used in the measurement (1000 kg/m$^3$); the viscosity of the carrier fluid used in the measurement (0.001 kg/m-s); and the density of the deposited material (1000 kg/m$^3$).

Statically and dynamically fit parameters are optimized over a search range to minimize the error between the measured and predicted frequency shift and dissipation shift values.

Statically fit parameters are fit using the first time point of the data to be fit (i.e. the last time point in Stage 2) and then maintained as constants for the remainder of the fit. The statically fit parameter in this method is the elastic shear modulus of the deposited layer was bound between 1 Pa and 10000 Pa, inclusive.

Dynamically fit parameters are fit at each time point of the data to be fit. At the first time point to be fit, the optimum dynamic fit parameters are selected within the search range described below. At each subsequent time point to be fit, the fitting results from the prior time point are used as a starting point for localized optimization of the fit results for the current time point. The dynamically fit parameters in this method are: the viscosity of the deposited layer was bound between 0.001 kg/m-s and 0.1 kg-m-s, inclusive; and the thickness of the deposited layer was bound between 0.1 nm and 1000 nm, inclusive.

Derivation of Deposition Kinetics Parameter (Tau) from Fit QCM-D Data

Once the layer viscosity, layer thickness, and layer elastic shear modulus are determined from the frequency shift and dissipation shift data using the Voigt viscoelastic model, the deposition kinetics of the test sample can be determined. Determination of the deposition kinetics parameter (Tau) is performed by fitting an exponential function to the layer viscosity using the form:

$$\text{Viscosity}(t) = \text{Amplitude}\left(1 - \exp\left(\frac{t_0 - t}{Tau}\right)\right) + \text{Offset} \qquad \text{Eqn. 1}$$

where viscosity, amplitude, and offset have units of kg/m-s and t, $t_0$, and Tau have units of minutes, and "exp" refers to the exponential function $e^x$. The initial timepoint of this function ($t_0$) is determined by the time at which the test sample begins flowing across the QCM-D sensor surface, as determined by the absolute value of the frequency shift on the 3$^{rd}$ harmonic (|Δf3|) being greater than 1 Hz. Equation 1 should be used only on data which fall between $t_0$ and the end of stage 2. The amplitude of this function is determined by subtracting the maximum film viscosity determined from the Voigt viscoelastic model during stage 2 of the HPLC method from the minimum film viscosity determined from the Voigt viscoelastic model during stage 1 of the HPLC method. The offset of this function is the minimum layer viscosity determined from the Voigt viscoelastic model during stage 2 of the HPLC method. Tau is fit to minimize the sum of squared differences between the layer viscosity and the viscosity fit determined using Equation 1. Tau should be calculated to one decimal place. Fitted values for Tau determined from the two QCM-D flow cells in series should be averaged together to provide a single value for Tau for each run. Subsequently, Tau values from the triplicate runs should be averaged together to determine the mean Tau value for the test sample.

Quality Assurance

This sample should be analyzed to test and confirm proper functioning of the QCM-D instrument method. This test must be run successfully before valid data can be acquired.

Stability Test

The purpose of this test is to evaluate the stability of the QCM-D response (i.e. frequency shift and dissipation shift) throughout the pumping protocol described above. In this test, the sample injected during stage 2 of the pumping protocol described above should be degassed, deionized water (18.2 MΩ). Frequency shift and dissipation shift data for the third, fifth, seventh, and ninth harmonics (f3, f5, f7, and f9 and d3, d5, d7, and d9 for the frequency and dissipation shifts, respectively) are to be monitored. For the purposes of this stability test, stability is defined as obtaining an absolute value of less than 0.75 Hz/hour for the slope of the $1^{st}$ order linear best fit across 30 contiguous minutes of frequency shift and also an absolute value of less than 0.2 Hz/hour for the slope of the $1^{st}$ order linear best fit across 30 contiguous minutes of dissipation shift, from each of the third, fifth, seventh, and ninth harmonics. If this stability criterion is not met during this test, this indicates failure of the stability test and evaluation of the implementation of the experimental method is required before further testing. Valid data cannot be acquired unless this stability test is run successfully.

Results

The Tau Value is calculated for four silicone emulsions.

| Material | Tau Value |
|---|---|
| SLM 21200 | 1.7 |
| SLM 2121-4 | 2.7 |
| SLM 21230 - mod B | 3.7 |
| X-22-8699-3S | 8.9 |

Yellowing

Certain silicone materials, e.g., aminosilicones, are believed to react with adjunct materials comprising an aldehyde or ketone groups to discolor the composition. In many instances these materials comprising aldehyde or ketone groups are perfume components.

Test Method for Measuring Yellowing of Compositions Containing Silicone:

Silicone samples for yellowing testing are prepared by mixing with an aldehydic perfume, and water. Suitable aldehydic perfumes may include one or more of the perfume ingredients listed in Table I.

TABLE I

Exemplary Perfume Ingredients

| Number | IUPAC Name | Trade Name | Functional Group |
|---|---|---|---|
| 1 | Benzaldehyde | Benzaldehyde | Aldehyde |
| 2 | 6-Octenal, 3,7-dimethyl- | Citronellal | Aldehyde |
| 3 | Octanal, 7-hydroxy-3,7-dimethyl- | Hydroxycitronellal | Aldehyde |
| 4 | 3-(4-tert-butylphenyl)butanal | Lilial | Aldehyde |
| 5 | 2,6-Octadienal, 3,7-dimethyl- | Citral | Aldehyde |
| 6 | Benzaldehyde, 4-hydroxy-3-methoxy- | Vanillin | Aldehyde |
| 7 | 2-(phenylmethylidene)octanal | Hexyl Cinnamic Aldehyde | Aldehyde |
| 8 | 2-(phenylmethylidene)heptanal | Amyl Cinnamic Aldehyde | Aldehyde |
| 9 | 3-Cyclohexene-1-carboxaldehyde, dimethyl- | Ligustral, | Aldehyde |
| 10 | 3-Cyclohexene-1-carboxaldehyde, 3,5-dimethyl- | Cyclal C | Aldehyde |
| 11 | Benzaldehyde, 4-methoxy- | Anisic Aldehyde | Aldehyde |
| 12 | 2-Propenal, 3-phenyl- | Cinnamic Aldehyde | Aldehyde |
| 13 | 5-Heptenal, 2,6-dimethyl- | Melonal | Aldehyde |
| 14 | Benzenepropanal, 4-(1,1-dimethylethyl)- | Bourgeonal | Aldehyde |
| 15 | Benzenepropanal, .alpha.-methyl-4-(1-methylethyl)- | Cymal | Aldehyde |
| 16 | Benzenepropanal, .beta.-methyl-3-(1-methylethyl)- | Florhydral | Aldehyde |
| 17 | Dodecanal | Lauric Aldehyde | Aldehyde |
| 18 | Undecanal, 2-methyl- | Methyl Nonyl Acetaldehyde | Aldehyde |
| 19 | 10-Undecenal | Intreleven Aldehyde Sp | Aldehyde |
| 20 | Decanal | Decyl Aldehyde | Aldehyde |
| 21 | Nonanal | Nonyl Aldehyde | Aldehyde |
| 22 | Octanal | Octyl Aldehyde | Aldehyde |
| 23 | Undecenal | Iso C-11 Aldehyde | Aldehyde |
| 24 | Decanal, 2-methyl- | Methyl Octyl Acetaldehyde | Aldehyde |
| 25 | Undecanal | Undecyl Aldehyde | Aldehyde |
| 26 | 2-Undecenal | 2-Undecene-1-Al | Aldehyde |
| 27 | 2,6-Octadiene, 1,1-diethoxy-3,7-dimethyl- | Citrathal | Aldehyde |
| 28 | 3-Cyclohexene-1-carboxaldehyde, 1-methyl-4-(4-methylpentyl)- | Vernaldehyde | Aldehyde |
| 29 | Benzenepropanal, 4-methoxy-.alpha.-methyl- | Canthoxal | Aldehyde |
| 30 | 9-Undecenal, 2,6,10-trimethyl- | Adoxal | Aldehyde |
| 31 | Acetaldehyde, [(3,7-dimethyl-6-octenyl)oxy]- | Citronellyl Oxyacetaldehyde | Aldehyde |
| 32 | Benzeneacetaldehyde | Phenyl Acetaldehyde | Aldehyde |
| 33 | Benzeneacetaldehyde, .alpha.-methyl- | Hydratropic Aldehyde | Aldehyde |
| 34 | Benzenepropanal, .beta.-methyl- | Trifernal | Aldehyde |

An example of a suitable aldehydic perfume is one which contains by weight: 13% Lilial, 11% Hexyl Cinnamic Aldehyde, 3.2% Anisic Aldehyde, and 72.8% non-aldehydic perfume ingredients. Silicone, aldehydic perfume and water components are mixed according to the concentrations given in Table II, which are given as % by weight of the final composition. Mixing is achieved by stirring with an overhead mixer using a 45 degree pitched or Rushton blade at ~300-500 RPM. After mixing to prepare the sample, it is placed into a glass jar and sealed, then stored at 21° C. for a period of 72 hours. A reference sample is also mixed, which is composed of the perfume material and water, without any silicone.

TABLE II

Composition of Samples for Yellowing Test (values are % by weight of final composition).

| | |
|---|---|
| Aldehydic Perfume | 0.8% |
| Silicone (omitted from Reference sample) | 5.0% |
| Water | Balance to 100% |

The degree of yellowing is assessed using a spectrophotometer instrument capable of measuring CIELAB, following the manufacturers standard instructions to measure the *b value. A suitable instrument is a Hunter LABScan. The instrument is calibrated according to instrument specifications and protocol. The setup parameters of the Hunter LAB Scan Instrument include Luminance: D65, Color Space: CIELAB, Area View: 1.0, Port Size: 1.0, UV Filter: In, and a sample cover cup is used to cover the port and sample to prevent background light interference.

Ten milliliters of the prepared silicone test sample to be tested are placed into a clear plastic 50×15 mm petri dish with a lid (e.g. NUNC brand). The sample is analyzed and the Hunter *b value is recorded. The reference sample prepared using the same perfume material is also measured in the same way. For each material tested, at least two replicates samples should be prepared, measured and the results averaged.

To determine the degree of yellowing (% change), the following equation is applied:

$$\text{Yellowing}=[(*b \text{ silicone test sample}-*b \text{ reference})/*b \text{ reference}]\times 100$$

Yellowing Data:

TABLE III

Yellowing Data - % Change in *b Values for Silicone and Aldehydic Perfume

| Example | Silicone | Supplier | Yellowing (% Change in *b Value vs. Nil Silicone Reference) |
|---|---|---|---|
| Example 1 | KF-873 | Shin-Etsu Silicones, Akron, OH | 17.4% |

TABLE III-continued

Yellowing Data - % Change in *b Values for Silicone and Aldehydic Perfume

| Example | Silicone | Supplier | Yellowing (% Change in *b Value vs. Nil Silicone Reference) |
|---|---|---|---|
| Example 2 | X22-8699-S | Shin-Etsu Silicones, Akron, OH | 7.0% |
| Example 3 | Y-17578 | Momentive Performance Materials, Waterford, NY | 12.4% |
| Example 4 | Magnasoft Plus | Momentive Performance Materials, Waterford, NY | 12.9% |
| Example 5 | X22-8699-3S | Shin-Etsu Silicones, Akron, OH | 53.7% |
| Example 6 | Y-17579 | Momentive Performance Materials, Waterford, NY | 52.5% |

EXAMPLES

Example 1

Quaternary Ammonium Compound

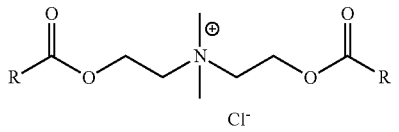

R = tallow (IV ~ 20)

Synthesized via the reaction of 1 equivalent of N-methyldiethanolamine with approximately 2 equivalents of tallow fatty acid or tallow methyl ester, followed by quaternization with methyl chloride.

Example 2

SLM 21230-mod B

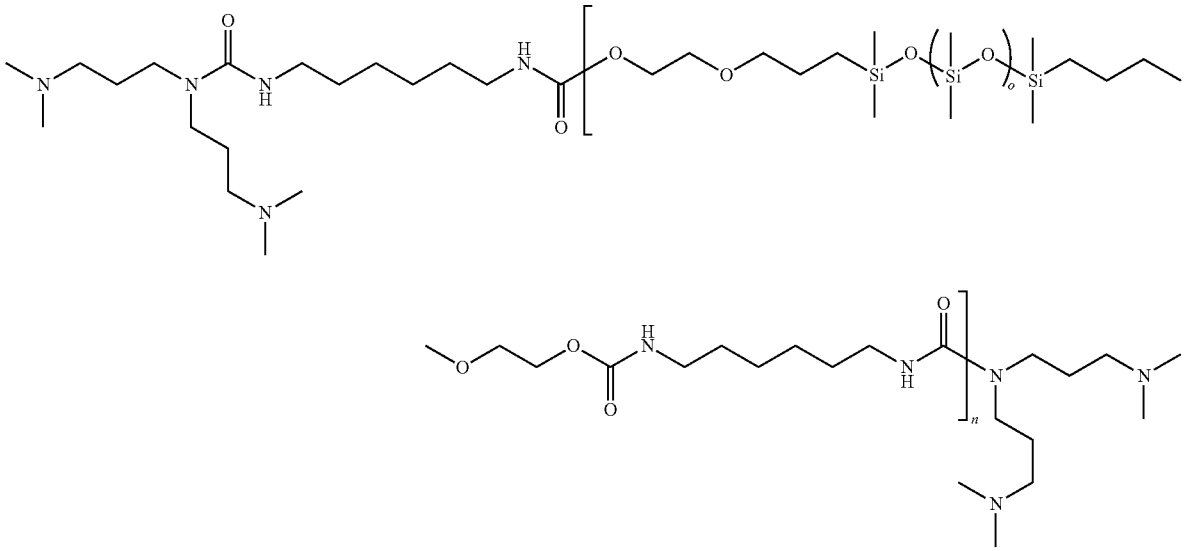

n = 2
o = 50

Two equivalents of □,□-dihydrogenpolydimethylsiloxane (Available from Wacker Silicones, Munich, Germany), having degree of polymerization of 50, is mixed with 4 equivalents of 2-hydroxyethyl allyl ether and heated to 100° C. A catalytically amount of Karstedt's catalyst solution is added, whereupon the temperature of the reaction mixture rises to 119° C. and a clear product is formed. Complete conversion of the silicon-bonded hydrogen is achieved after one hour at 100 to 110° C. Two equivalents of N,N-bis[3-(dimethylamino)propyl]amine (Jeffcat Z130 available from Wacker Silicones, Munich, Germany) and 3 equivalents of hexamethylenediisocyanate (HDI) are then meteringly added in succession. Urethane formation is then catalyzed with a catalytic amount of di-n-butyltin dilaurate. After the batch has been held at 100° C. for 2 hours it is cooled down, forming a very viscous liquid. MW is approximately 10,000.

Example 3

SLM 2121-4

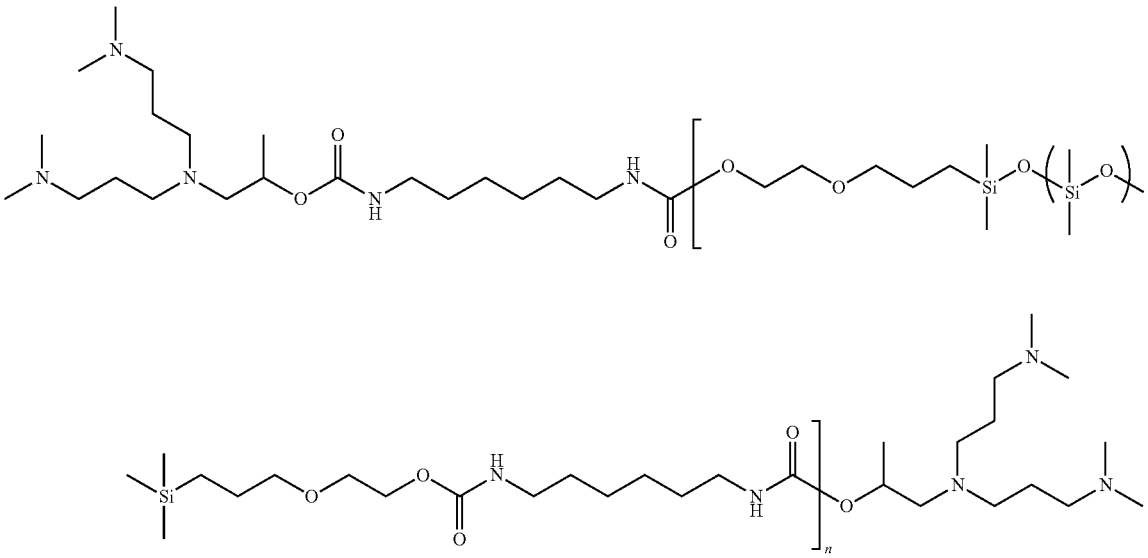

n = 2
o = 50

Two equivalents of ⊓,⊓̃dihydrogenpolydimethylsiloxane (Available from Wacker Silicones, Munich, Germany), having degree of polymerization of 50, is mixed with 4 equivalents of 2-hydroxyethyl allyl ether and heated to 100° C. A catalytically amount of Karstedt's catalyst solution is added, whereupon the temperature of the reaction mixture rises to 119° C. and a clear product is formed. Complete conversion of the silicon-bonded hydrogen is achieved after one hour at 100 to 110° C. Two equivalents of N,N-bis(3-dimethylaminopropyl)isopropanolamine (Jeffcat ZR50 available from Wacker Silicones, Munich, Germany) and 3 equivalents of hexamethylenediisocyanate (HDI) are then meteringly added in succession at a reaction temperature of 120° C. Urethane formation is then catalyzed with a catalytic amount of di-n-butyltin dilaurate. After the batch has been held at 120° C. for 3 hours it is cooled down, forming a very viscous liquid.

Example 4

X-8699-3S

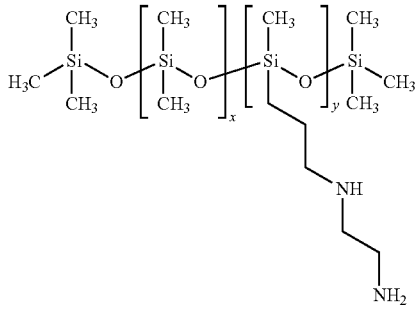

x = approximately 444
y = approximately 9

Synthesized via the equilibration reaction of hexamethyldisiloxane, octamethylcyclotetrasiloxane and, N,N',N'',N'''-tetrakis(2-aminoethyl)-2,4,6,8-tetramethyl-cyclotetrasiloxane-2,4,6,8-tetrapropanamine, or the condensation reaction of aminoethylaminopropyltrimethoxysilane, a silanol or alkoxysilane terminated polydimethylsiloxane and a monosilanol or monoalkoxysilane terminated polydimethylsiloxane.

Example 5

SLM 21230

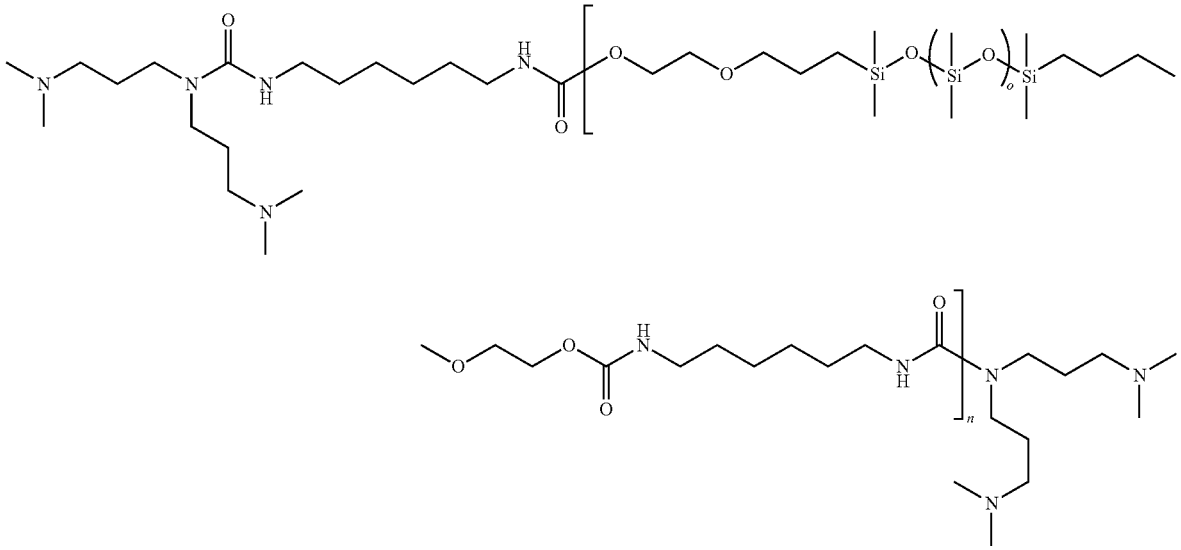

n = 1
o = 50

□neequivalent of □,□-dihydrogenpolydimethylsiloxane (Available from Wacker Silicones, Munich, Germany), having degree of polymerization of 50, is mixed with 2 equivalents of 2-hydroxyethyl allyl ether and heated to 100° C. A catalytically amount of Karstedt's catalyst solution is added, whereupon the temperature of the reaction mixture rises to 119° C. and a clear product is formed. Complete conversion of the silicon-bonded hydrogen is achieved after one hour at 100 to 110° C. Two equivalents of N,N-bis[3-(dimethylamino)propyl]amine (Jeffcat Z130 available from Wacker Silicones, Munich, Germany) and 2 equivalents of hexamethylenediisocyanate (HDI) are then meteringly added in succession. Urethane formation is then catalyzed with a catalytic amount of di-n-butyltin dilaurate. After the batch has been held at 100° C. for 2 hours it is cooled down, forming a very viscous liquid.

Example 6

SLM 466-01-05

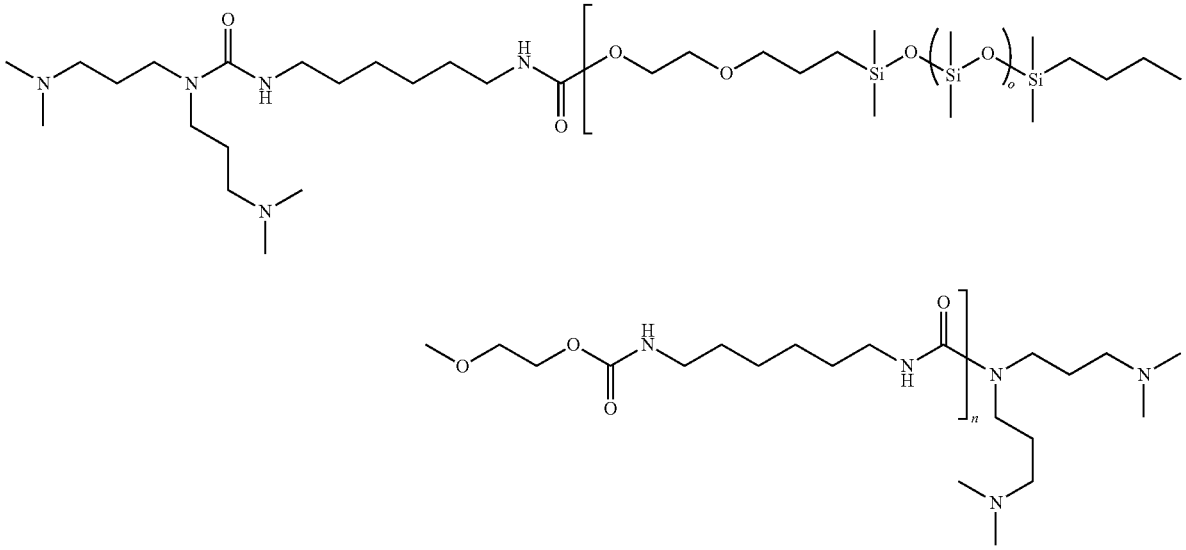

n = 2
o = 50

□woequivalents of □,□-dihydrogenpolydimethylsiloxane (Available from Wacker Silicones, Munich, Germany), having degree of polymerization of 50, is reacted with 4 equivalents of 2-hydroxyethyl allyl ether. This product is then reacted with 2 equivalents of N,N-bis[3-(dimethylamino)propyl]amine (Jeffcat Z130 available from Wacker Silicones, Munich, Germany) and 3 equivalents of hexamethylenediisocyanate (HDI). MW is approximately 9,000.

Example 7

PDMS

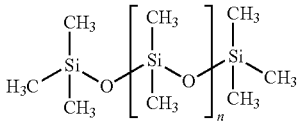

Synthesized via the equilibration reaction of hexamethyldisiloxane and octamethylcyclotetrasiloxane.

Example 8

SLM Emulsion 20.8 g of silicone SLM silicone is mixed with 2.1 g hydrogenated tallow alkyl (2-ethylhexyl), dimethyl ammonium methyl sulfates (sold under the product name ARQUAD HTL8-MS) for 15 minutes using at 250 rpm RPM using an overhead IKA WERK mixer. Four dilutions of water (11.7 g, 22.1 g, 22.1 g, 22.1 g) are added, with each dilution of water allowing for the solution to mix for an additional 15 minutes at 250 rpm. As a final step, glacial acetic acid was added drop-wise to reduce the pH to about 4.9 to 5.1 while the emulsion continued to mix. The weight of final mixture was 104 g. Subsequent to the emulsification is the particle size measurement using Horiba LA-930 to achieve a particle size between 100 nm to 900 nm at a refractive index of 102. If the average particle size of the emulsion was greater than 900 nm, emulsions are further processed by means of a homogenizer for approximately 3 minutes in 1 minute intervals.

Any of the silicone emulsion may be incorporated into a fabric care composition. Examples may include US 2004/0204337; US 2003/0126282.

All documents cited in the DETAILED DESCRIPTION OF THE INVENTION are, in relevant part, incorporated herein by reference; the citation of any document is not to be construed as an admission that it is prior art with respect to the present invention While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of identifying an active for use as a fabric care active comprising the steps:

(a) assessing a Friction Test Ratio of the active;

(b) assessing a Compression Test Ratio of the active; and (c) assessing a Stiffness Test Ratio of the active.

2. The method of claim 1, further comprising the steps of determining whether:

(a) the Friction Test Ratio of the active is from 0.83 to 0.90, alternatively from 0.85 to 0.89;

(b) the Compression Test Ratio of the active is lower than 0.86, alternatively from 0.70 to 0.86, alternatively from 0.73 to 0.86;

(c) the Stiffness Test Ratio of the active is lower than 0.67, alternatively from 0.35 to 0.67, alternatively from 0.39 to 0.64, alternatively from 0.44 to 0.64.

3. The method of claim 2, wherein the active is a silicone emulsion, and further comprising the step of assessing a Tau Value of the active.

4. The method of claim 3, further comprising the step of determining whether the Tau Value of the active is between about 1 and about 10, preferably between about 1 and about 5.

* * * * *